US005907754A

United States Patent [19]

Kim et al.

[11] Patent Number: 5,907,754

[45] Date of Patent: May 25, 1999

[54] METHOD FOR DRIVING DEVELOPMENT UNIT FOR IMAGE FORMING APPARATUS TO SIMULTANEOUSLY REMOVE DRIP LINES

[75] Inventors: Wan-ha Kim; Kee-son Chang; Jin-geun Kwak, all of Suwon, Rep. of Korea

[73] Assignee: Samsung Electronics Co., Ltd., Kyungki-Do, Rep. of Korea

[21] Appl. No.: 09/074,386

[22] Filed: May 8, 1998

[30] Foreign Application Priority Data

Aug. 4, 1997 [KR] Rep. of Korea ..... 97/37261

[51] Int. Cl.[6] ..... G03G 15/01; G03G 15/10

[52] U.S. Cl. ..... 399/233; 399/237; 399/249

[58] Field of Search ..... 399/237, 249, 399/228, 223, 233

[56] References Cited

U.S. PATENT DOCUMENTS

| | | | |
|---|---|---|---|
| 4,754,301 | 6/1988 | Kasamura et al. | 399/228 |
| 4,801,966 | 1/1989 | Ikeda | 399/228 |
| 5,828,934 | 10/1998 | Tamura et al. | 399/228 |

*Primary Examiner*—S. Lee
*Attorney, Agent, or Firm*—Sughrue, Mion, Zinn, Macpeak & Seas, PLLC

[57] ABSTRACT

A method for driving development devices of an image forming apparatus including the steps of: (a) simultaneously rotating gear cams of the respective development devices for colors Y (yellow), M (magenta), C (cyan) and K (black); (b) determining whether the frame of the development devices is lifted to a preset position; (c) rotating a developing roller; (d) coating a developer liquid on an image portion of a photoreceptor belt; (e) determining whether the image portion has passed through a transfer roller or not; (f) simultaneously rotating the gear cams of the respective development devices for colors Y, M, C and K if the image portion has passed through the transfer roller; (g) determining whether the distance between the frame and the photoreceptor belt is a preset value; (h) simultaneously stopping the gear cams of the respective development devices for colors Y, M, C and K if the distance between the frame and the photoreceptor belt is the preset value; and (i) simultaneously removing drip lines by simultaneously reversely rotating first and second squeegee rollers in the respective development devices. Therefore, the overall configuration becomes simplified, thereby reducing the fabrication cost, as well as making maintenance and repair thereof easy.

10 Claims, 5 Drawing Sheets

METHOD FOR DRIVING DEVELOPMENT UNIT FOR IMAGE FORMING APPARATUS TO SIMULTANEOUSLY REMOVE DRIP LINES

BACKGROUND OF THE INVENTION

1. Field of the Invention

The present invention relates to a method for driving a development unit for an image forming apparatus, and more particularly, to a method for driving a development unit for an image forming apparatus which can simultaneously remove drip lines generated during development from the respective developing devices for colors Y (yellow), M (magenta), C (cyan) and K (black).

2. Description of the Related Art

An image forming apparatus reproduces characters or images onto a recording medium according to transferred characters or picture image data signals. An image forming apparatus generally includes a photoreceptor member, e.g., a photoreceptor drum or a photoreceptor belt, which forms a latent electrostatic image, a charging unit which charges the photoreceptor member, and an exposure unit which forms a latent electrostatic image having a predetermined pattern by scanning light onto the charged photoreceptor member. An image forming apparatus also includes a development unit which develops the latent electrostatic image by supplying a development medium, e.g., a toner or a developer liquid, on the exposed latent electrostatic image, and a transfer unit which transfers the developed image to the recording medium by applying pressure or heat.

FIG. 1 is a schematic diagram showing a general image forming apparatus. Referring to FIG. 1, the image forming apparatus includes a photoreceptor belt 104 installed to circulate around first, second and third belt rollers 101, 102 and 103. A discharger 105 removes charges remaining in the photoreceptor belt 104, whereas charger 106 newly charges the photoreceptor belt 104. Exposure units 107, 108, 109 and 110, each having a laser scanning unit (not shown), scan a laser beam for the purpose of selectively discharging the image forming portion of the photoreceptor belt 104 thereby forming an image-shaped pattern. Development units 111, 112, 113 and 114 for respective colors Y, M, C and K, develop the latent electrostatic image formed on the photoreceptor belt 104. A drier 115 dries the developer liquid supplied to the latent electrostatic image. Finally transfer unit 116 transfers an arbitrarily developed image formed on the photoreceptor belt 104 to a recording medium 117 such as a sheet of paper or a film.

The development unit 111 includes a developing roller 111*a* for coating the developer liquid on the photoreceptor belt 104, a developer liquid supplier 111*b* which supplies the developer liquid to the developing roller 111*a*, and a cleaning roller 111*c* which removes developer liquid embedded on the rear surface of the developing roller 111*a*. The developer liquid develops latent electrostatic images formed on the photoreceptor belt. The development unit 111 also includes, first and second squeegee rollers 111*d* and 111*e* which remove the developer liquid remaining on the photoreceptor belt 104, as well as includes first and second blades 111*f* and 111*g* which remove the developer liquid embedded on the first and second squeegee rollers 111*d* and 111*e*. The development unit 111 further includes a developer liquid recovery container 111*h* for recovering the developer liquid removed by the cleaning roller 111*c* and the blades 111*f* and 111*g*.

The drier 115 includes a heating roller 115*h* which dries the developer liquid embedded on the photoreceptor belt 104.

The transfer unit 116 includes a transfer roller 116*t* disposed close to the first belt roller 101, wherein the photoreceptor belt 104 is interposed therebetween to reciprocally rotate, thereby transferring the image on the photoreceptor belt 104 to the transfer roller. The transfer unit 116 also includes a fixing roller 116*p* disposed close to the transfer roller 116*t* to reciprocally rotate therewith, thereby fixing the image transferred to the transfer roller 116*t* onto the recording sheet 117.

In the image forming apparatus having the aforementioned configuration, when the developing roller 111*a* of the development unit 111 makes contact with the photoreceptor belt 104 to supply a developer liquid thereto and is then removed from contact with the photoreceptor belt 104, a drip line 200*d* having a shape in the form of a dripping fluid is formed on the photoreceptor belt 104, as shown in FIG. 2. The drip line 200*d* causes poor printing such as blotted images. Conventionally, the drip line 200*d* is removed by the first and second squeegee rollers 111*d* and 111*e*. In other words, as shown in FIG. 2, if the drip line 200*d* is formed on the photoreceptor belt 104, the first squeegee roller 111*d* is first rotated in the same direction as the direction in which the photoreceptor belt 104 travels, until the drip line 200*d* gets closer to the first squeegee roller 111*d*. Then, as shown in FIG. 3, the first squeegee roller 111*d* is reversely rotated and the first blade 111*f* is brought into contact with the first squeegee roller 111*d*. Accordingly, developer liquid 200 is caught in the first blade 111*f* and drops downward. As a result, the drip line 200*d* is removed.

According to the conventional drip line removing method, the drip lines of the respective development units 111, 112, 113 and 114 for the colors Y, M, C and K are sequentially removed. Thus, development units and power transmission mechanisms are separately provided for each. In other words, four frames, four motors, four shafts, eight cams and each power transmission system must be provided for the respective units. Accordingly, the overall configuration becomes complex, which increases the fabrication cost as well as makes maintenance and repair difficult.

SUMMARY OF THE INVENTION

To solve the above problem, it is an objective of the present invention to provide a method, for driving a development unit of an image forming apparatus, which simultaneously removes drip lines generated during development of an image from respective development devices for colors Y, M, C and K.

Accordingly, to achieve the above objective, there is provided a method, for driving development devices of an image forming apparatus, comprising the steps of: (a) simultaneously rotating gear cams of the respective development devices for colors Y (yellow), M (magenta), C (cyan) and K (black); (b) determining whether the frame of the development devices is lifted to a preset position; (c) rotating a developing roller; (d) coating a developer liquid on an image portion of a photoreceptor belt; (e) determining whether the image portion has passed through a transfer roller or not; (f) simultaneously rotating the gear cams of the respective development devices for colors Y, M, C and K if the image portion has passed through the transfer roller; (g) determining whether the distance between the frame and the photoreceptor belt is a preset value; (h) simultaneously stopping the gear cams of the respective development devices for colors Y, M, C and K if the distance between the frame and the photoreceptor belt is a preset value; and (i) simultaneously removing drip lines by simultaneously reversely rotating first and second squeegee rollers in the respective development devices.

After step (i) of removing the drip lines, there is further provided the step of lowering the frame to a place spaced apart from the photoreceptor belt by 20 mm, by rotating the gear cams.

According to the present invention, unlike the conventional art, since drip lines are simultaneously removed from the respective development devices for Y, M, C and K colors, the numbers of the frames, motors, shafts and cams can be reduced from 4, 4, 4 and 8 to 1, 1, 1 and 2, respectively. Therefore, the overall configuration is simplified, thereby reducing the fabrication cost as well as making the maintenance and repair thereof easy.

BRIEF DESCRIPTION OF THE DRAWINGS

The above and other objectives and advantages of the present invention will become more apparent by describing in detail a preferred embodiment thereof with reference to the attached drawings in which.

DESCRIPTION OF THE PREFERRED EMBODIMENTS

Figure 1:
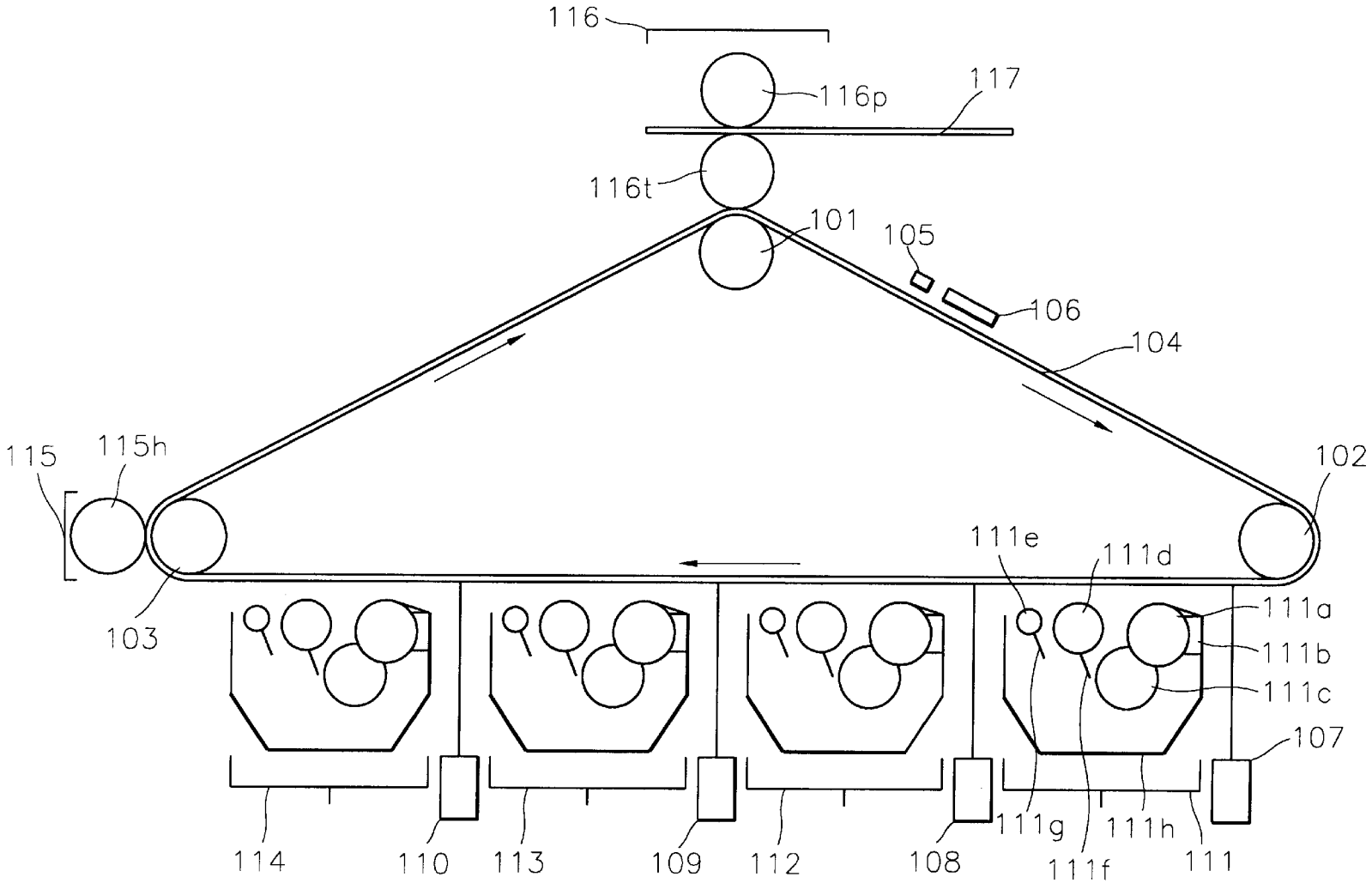
FIG. 1(PRIOR ART)
FIG. 1 is a schematic diagram of a general image forming apparatus.
Figure 2:
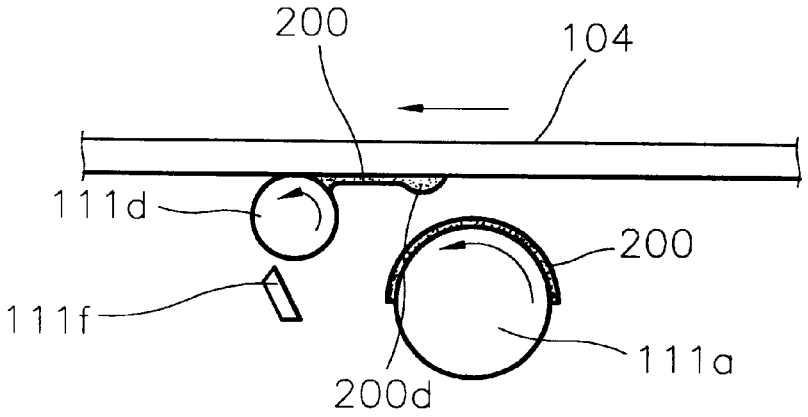
FIG. 2(PRIOR ART)
FIGS. 2 and 3 show a drip line formed on a photoreceptor belt in the image forming apparatus of FIG. 1, and a procedure for removing the same, respectively.
Figure 3:
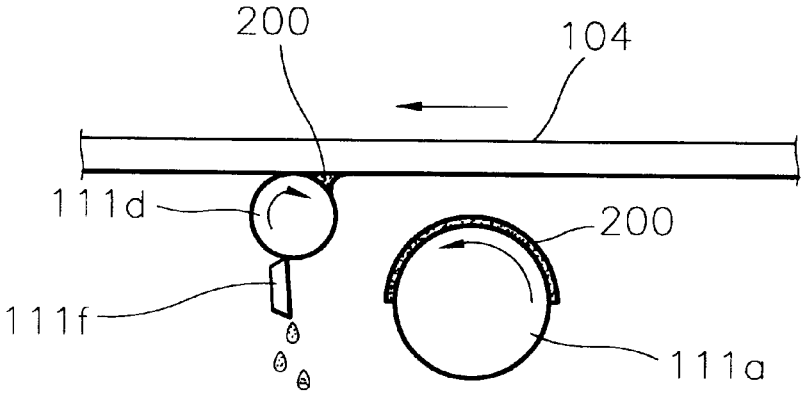
FIG. 3(PRIOR ART)
Figure 4:
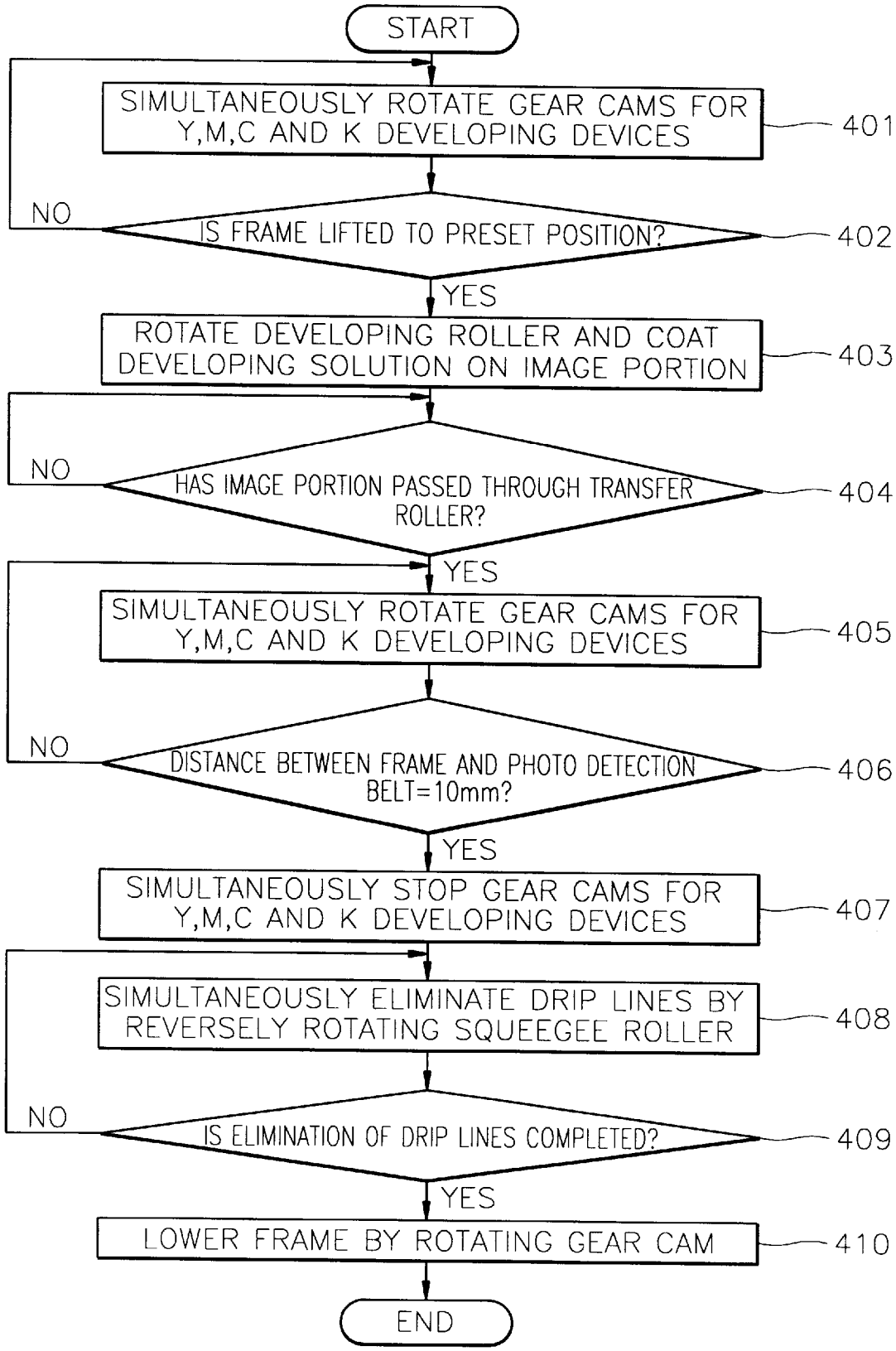
FIG. 4 is a flow chart explaining the operating procedure of a method for driving development devices of an image forming apparatus according to the present invention.
Figure 5:
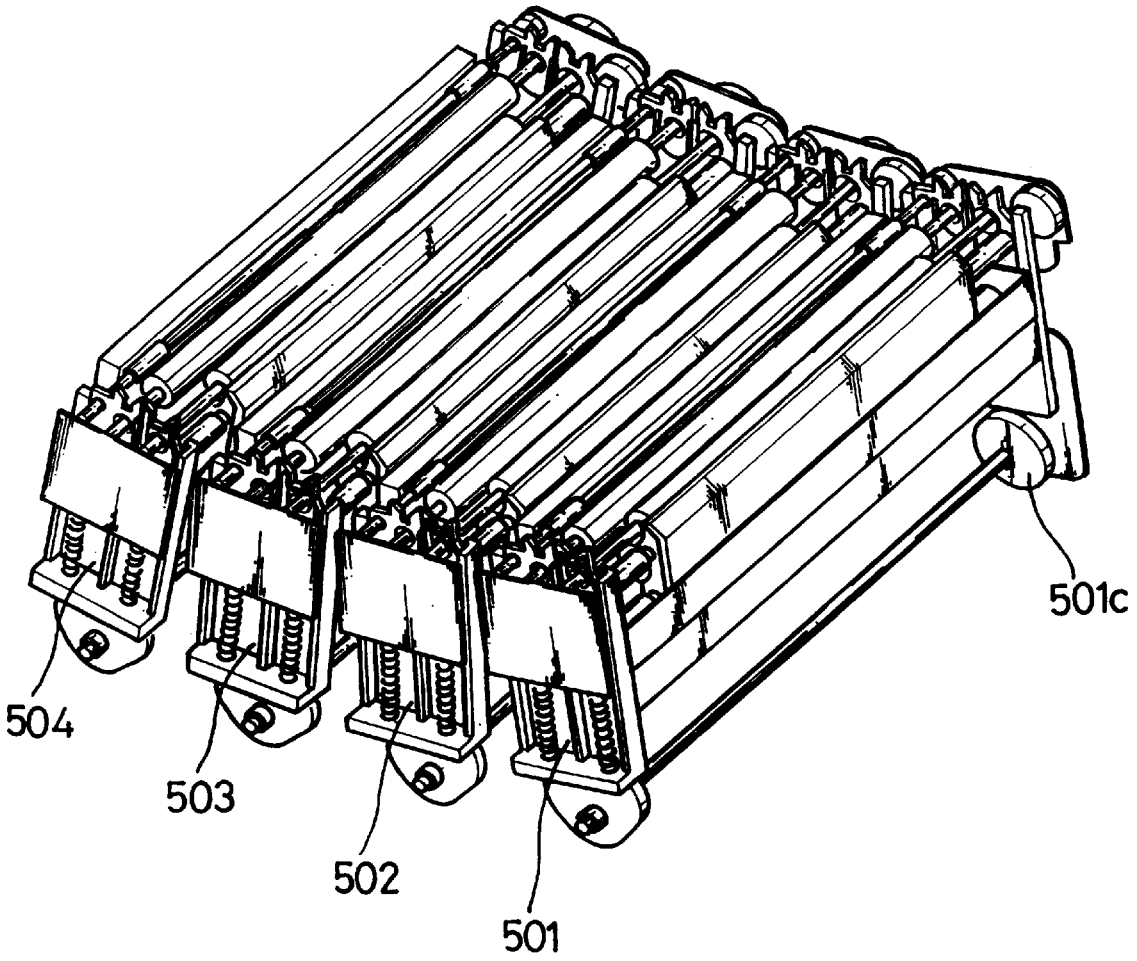
FIG. 5 is a perspective view of respective development devices for Y, M, C and K colors, to which the method for driving development devices of an image forming apparatus according to the present invention is employed.
Figure 6:
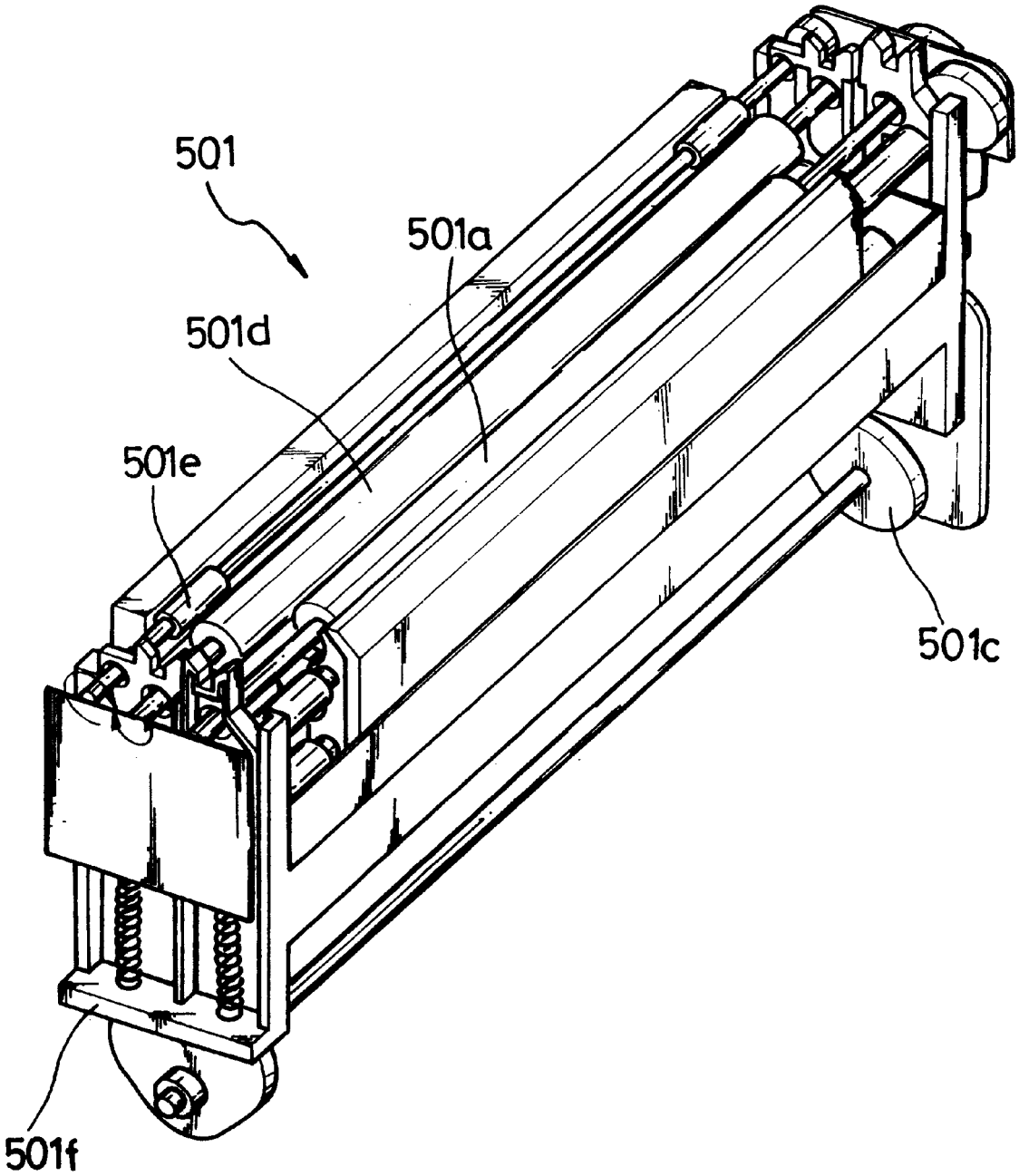
FIG. 6 is a partially exploded perspective view of the development device for the Y color, shown in FIG. 5.

Referring to FIGS. 4 through 6, wherein elements similar to those of FIG. 1 are given like reference characters, the driving method, for a development unit of an image forming apparatus, according to the present invention is as follows. First, gear cams 501*c*, 502*c*, 503*c* and 504*c* of the respective development devices 501, 502, 503 and 504 for the respective colors Y, M, C and K are simultaneously rotated (step 401). Then, it is determined whether the frame 501*f* of the development device 501 for the Y color is lifted to a preset position (step 402). Because the development devices 501, 502, 503 and 504 have all the same structure, the development device 501 for the Y color will be explained representatively.) In other words, it is determined whether the frame 501*f* is lifted to a position at which the distance between a developing roller 501*a* of the development device 501 and the photoreceptor belt 104 becomes 0.15 mm, for example.

If the frame 501*f* is not lifted to the preset position in the determining step 402, the gear cam 501*c* is continuously rotated, whereas if the frame 501*f* is lifted to the preset position, the developing roller 501*a* is then rotated to coat a developer liquid on an image portion (not shown) of a photoreceptor belt 104 (step 403). At this time, to remove the developer liquid remaining after being used for development, a first squeegee roller 501*d* is rotated, in the same direction as that in which the photoreceptor belt 104 travels, so that it makes contact with the photoreceptor belt 104 with a pressure of 10 kgf, for example. The second squeegee roller 50l*e* is rotated in a direction which is the reverse of that in which the photoreceptor belt 104 travels so that it makes contact with the photoreceptor belt 104 with a pressure of 2 kgf, for example.

If the developing procedures for the respective colors Y, M, C and K are completed in such a manner, it is determined whether the image portion has passed through the transfer roller (116*t*) or not (step 404). If the image portion has not passed through the transfer roller 116*t* in step 404, it is continuously determined whether the image portion has passed through the transfer roller 116*t* or not. If the image portion has passed through the transfer roller 116*t*, the gear cams 501*c*, 502*c*, 503*c* and 504*c* of the respective development devices 501, 502, 503 and 504 for the respective colors Y, M, C and K are simultaneously rotated (step 405).

Thereafter, it is determined whether the distance between the frame 501*f* and the photoreceptor belt 104 is a predetermined value, e.g., 10 mm (step 406). If the distance between the frame 501*f* and the photoreceptor belt 104 is not the predetermined value, the gear cams 501*c*, 502*c*, 503*c* and 504*c* are continuously rotated. If the distance between the frame 501*f* and the photoreceptor belt 104 is the predetermined value, the gear cams 501*c*, 502*c*, 503*c* and 504*c* are simultaneously stopped (step 407). Also, the squeegee rollers 501*d* and 501*e* in the respective development devices are simultaneously reversely rotated, thereby simultaneously removing the drip lines (step 408). At this time, preferably, the first squeegee roller 501*d* is brought into contact with the photoreceptor belt 104 with a pressure of 9 kgf, for example, and the second squeegee roller 501*e* is brought into contact with the photoreceptor belt 104 with a pressure of 1 kgf, for example. In such a manner, the drip lines are simultaneously removed due to the features of the present invention.

It is determined by a predetermined elapsed time whether the removal of the drip lines is completed or not (step 409). If the removal of the drip lines is not completed in the step 409, the drip lines are continuously removed. If the removal of the drip lines is completed, the frame 501*f* is lowered to a place spaced a predetermined distance apart from the photoreceptor belt 104, e.g., 20 mm, by rotating the gear cam 501*c* (step 410). Accordingly, the respective developing rollers are all separated from the photoreceptor belts 104 and the driving of the development devices for removing drip lines is completed.

As described above, according to the present invention, since the drip lines are simultaneously removed from the respective development devices for colors Y, M, C and K, the numbers of the frames, motors, shafts and cams can be reduced to 1, 1, 1 and 2, compared to the conventional 4, 4, 4 and 8, respectively. Therefore, the overall configuration becomes simplified, and the maintenance and repair thereof become easy, thereby reducing the fabrication cost.

It should be understood that the invention is not limited to the illustrated embodiment. Many changes and modifications can be made within the scope of the invention, by one of ordinary skill in the art, which are intended to be encompassed within the protection sought for the invention as set forth in the appended claims.

What is claimed is:

1. A method for driving development devices for an image forming apparatus comprising the steps of:

(a) simultaneously rotating gear cams of respective development devices for colors Y (yellow), M (magenta), C (cyan) and K (black);

(b) determining whether a frame of the development devices is lifted to a preset position;

(c) rotating a developing roller;

(d) coating a developer liquid on an image portion of a photoreceptor belt which travels in a first direction;

(e) determining whether the image portion has passed through a transfer roller or not;

(f) simultaneously rotating the gear cams of the respective development devices for colors Y, M, C and K if the image portion has passed through the transfer roller;

(g) determining whether a distance between the frame and the photoreceptor belt is a preset value;

(h) simultaneously stopping the gear cams of the respective development devices for colors Y, M, C and K if the distance between the frame and the photoreceptor belt is said preset value; and (i) simultaneously removing drip lines by simultaneously reversely rotating first and second squeegee rollers in the respective development devices.

2. The method according to claim 1, wherein the distance between the developing roller and the photoreceptor belt is maintained at 0.15 mm in steps (c) and (d).

3. The method according to claim 1, wherein the first squeegee roller in each respective development device is brought into contact with the photoreceptor belt with a pressure of 10 kgf in steps (c) and (d).

4. The method according to claim 3, wherein the first squeegee roller of each respective development device is rotated in a direction which is the same as that in which the photoreceptor belt travels.

5. The method according to claim 1, wherein the second squeegee roller of each respective development device is brought into contact with the photoreceptor belt with a pressure of 2 kgf in the steps (c) and (d).

6. The method according to claim 5, wherein the second squeegee roller of each respective development device is rotated in a direction opposite to that in which the photoreceptor belt travels.

7. The method according to claim 1, wherein said preset value of the distance between the frame and the photoreceptor belt is 10 mm in step (g).

8. The method according to claim 1, wherein the first squeegee roller of each respective development device is brought into contact with the photoreceptor belt with a pressure of 9 kgf in step (i).

9. The method according to claim 1, wherein the second squeegee roller of each respective development device is brought into contact with the photoreceptor belt with a pressure of 1 kgf in step (i).

10. The method according to claim 1, after the step (i) for removal of the drip lines, further comprising the step of:

lowering the frame to a position in which it is spaced apart from the photoreceptor belt by 20 mm by simultaneously rotating the gear cams.

* * * * *